US012252848B2

(12) United States Patent
Leroux

(10) Patent No.: US 12,252,848 B2
(45) Date of Patent: Mar. 18, 2025

(54) SAFETY DEVICE

(71) Applicant: Andre Leroux, Ivanhoe North (AU)

(72) Inventor: Andre Leroux, Ivanhoe North (AU)

( * ) Notice: Subject to any disclaimer, the term of this patent is extended or adjusted under 35 U.S.C. 154(b) by 768 days.

(21) Appl. No.: 17/593,005

(22) PCT Filed: Mar. 5, 2020

(86) PCT No.: PCT/AU2020/050205
§ 371 (c)(1),
(2) Date: Sep. 3, 2021

(87) PCT Pub. No.: WO2020/176943
PCT Pub. Date: Sep. 10, 2020

(65) Prior Publication Data

US 2022/0178087 A1 Jun. 9, 2022

(30) Foreign Application Priority Data

Mar. 5, 2019 (AU) ..... 2019900713

(51) Int. Cl.
*E01C 11/24* (2006.01)
*E04C 2/42* (2006.01)
(Continued)

(52) U.S. Cl.
CPC ..... *E01C 11/24* (2013.01); *E04C 2/42* (2013.01); *E04F 15/02172* (2013.01);
(Continued)

(58) Field of Classification Search
CPC . E01C 9/10; E01C 11/24; E01C 17/00; E04C 2/42; E04F 15/02172;
(Continued)

(56) References Cited

U.S. PATENT DOCUMENTS 3,348,459 A * 10/1967 Harvey ..... E01C 9/083 404/35
3,742,911 A * 7/1973 Lehe ..... A01K 1/0151 119/529

(Continued)

FOREIGN PATENT DOCUMENTS

| | | | |
|---|---|---|---|
| JP | H07305401 | A | 11/1995 |
| KR | 200459894 | Y1 | 4/2012 |
| KR | 2018000870 | U | 3/2018 |

OTHER PUBLICATIONS

International Search Report and Written Opinion for PCT/AU2020/050205 dated May 21, 2020.

*Primary Examiner* — Raymond W Addie
(74) *Attorney, Agent, or Firm* — Womble Bond Dickinson (US) LLP

(57) ABSTRACT

An attachment device for attachment to a pathway comprising a body having: a top surface for receiving foot traffic thereon; at least one point of flexure; and at least one arm extending from the point of flexure with the arm moveable about the point of flexure, the at least one arm configured to engage the pathway or a structural member of the pathway, wherein when engaged, the at least one arm secures the device to the pathway, wherein engagement of the at least one arm results in the device being compressively secured to the pathway in between two component members of the pathway.

24 Claims, 7 Drawing Sheets

(51) Int. Cl.

| | |
|---|---|
| ***E04F 15/02*** | (2006.01) |
| ***E04F 15/06*** | (2006.01) |
| ***E04F 15/10*** | (2006.01) |
| *E01C 9/10* | (2006.01) |
| *E01C 17/00* | (2006.01) |

(52) U.S. Cl.
CPC ..... *E04F 15/02183* (2013.01); *E04F 15/06* (2013.01); *E04F 15/105* (2013.01); *E01C 9/10* (2013.01); *E01C 17/00* (2013.01); *E04F 2290/00* (2013.01)

(58) Field of Classification Search
CPC ... E04F 15/02183; E04F 15/06; E04F 15/105; E04F 2290/00
USPC ..... 404/17–19, 43–46; 14/73.1
See application file for complete search history.

(56) References Cited

U.S. PATENT DOCUMENTS

| | | | | | |
|---|---|---|---|---|---|
| 3,765,136 | A | | 10/1973 | Mudd | |
| 4,488,833 | A | * | 12/1984 | Perry | E01D 15/22 14/27 |
| 4,654,245 | A | * | 3/1987 | Balzer | A47L 23/26 52/177 |
| 4,877,672 | A | * | 10/1989 | Shreiner | A47L 23/26 52/177 |
| 5,088,434 | A | * | 2/1992 | Harding | B63B 7/082 114/345 |
| 5,502,930 | A | * | 4/1996 | Burkette | G09F 15/0068 52/282.1 |
| 7,774,991 | B2 | * | 8/2010 | Fletcher | E01C 9/086 52/177 |
| 8,146,317 | B1 | * | 4/2012 | Fletcher | E04F 15/105 52/592.1 |

* cited by examiner

SAFETY DEVICE

The present application is a national stage application, filed under 35 U.S.C. § 371 of International Patent Application No. PCT/AU2020/050205, filed 5 Mar. 2020, which claims priority from Australian Provisional Patent Application 2019900713 filed 5 Mar. 2019, the entire contents of which are incorporated herein by reference.

TECHNICAL FIELD

The invention relates to a safety device for attachment to a pedestrian or vehicle pathway surface, in particular a grating.

BACKGROUND OF INVENTION

The following discussion of background art is included to explain the context of the present invention. A reference herein to a matter which is given as prior art is not to be taken as an admission that the matter was known or that the information it contains was part of the common general knowledge as at the priority date of any of the claims.

When designing and constructing pathways such as walkways, walking paths, footpaths, driveways and thoroughfares, there are minimum standards which must be adhered to. Depending on the purpose of the path or thoroughfare, these standards will often specify the load capacity, dimensions, surface friction and the required material strength. There exist a number of ways in which these standards can be met. In addition to the minimum standards, certain walking paths and thoroughfares include additional anti-slip features to mitigate safety hazards such as exposure to liquids, or to merely mitigate risk of slippage.

In particular, where higher levels of friction are required, coarse surfaces made of steel and/or rubber composites may be installed or attached to the thoroughfare or path. Alternatively, anti-slip fittings may be installed on top of pre-existing surfaces, and/or anti-slip coatings may be applied. Where the path or thoroughfare is an open structure, then such options are not easily applicable. For example, the majority of external platform sections on an oil rig comprise open-style grating, the advantages of which include allowing water to pass through the surface to avoid pooling up, so as to mitigate a slipping hazard. To minimise slip and trip hazards, anti-slip accessories are often applied to the outer edges of grating, see for example the step definition system of Australian Patent 2012202911. Further, anti-slip and highly visible step caps are commonly seen safety features attached to stairs. Further, as is the case with Australian Patent 2012202911, these accessories are often snap-fit devices which snap onto single portions of grating, and are susceptible to vertical and horizontal movement/play.

Additionally, there exists patent literature directed to fittings which are attached to surfaces to minimise the risk of slippage. For example, Korean Patent application KR20180000870U, Korean Patent KR200459894Y1 and U.S. Pat. No. 3,765,136A provide non-slip fittings which sit over load bars of a grated floor surface. In this application, a reference to a load bar is a reference to a load bearing bar depicted as items 24, 424, 824 in FIGS. 3, 6, and 11. The term cross-bar as used in this specification is referring to a cross bar depicted in items 14, 414, 814 in FIGS. 3, 6 and 11.

The fittings of Korean Patent application KR20180000870U and U.S. Pat. No. 3,765,136A have downwardly projecting arms which fit over and clamp load bars of a grated surface. Similarly, the device Korean Patent KR200459894Y1 comprises downwardly projecting arms which sit over load bars of a grated surface. However, the device of Korean Patent KR200459894Y1 comprises locking tabs which when the arms reach a certain depth below a load bar, the tabs project outwards and obstruct the upward movement of the fitting. The existing prior art is limited in that it provides fittings that cannot accommodate cross bars. Further, the prior art devices disclose an attachment configuration whereby the devices comprise an attachment bias that runs through the body of the device, and perpendicular to the load bars of a grated surface.

Further, with the current available technology, application of anti-slip accessories on grating is likely to mitigate some of the advantages of using the grating.

With respect to grating, one option is to install a non-porous anti-slip surface such as safe plates, safe tiles, or capping, all of which comprise high-frictional properties. Installation of these components requires attachment and/or adhesion of components to a surface. Where part of the anti-slip feature deteriorates, often the entire feature will require replacement. Further, placement of tiles or plates on top of grating is not desirable as it counteracts the numerous advantages of grating, for example, it causes water to pool, creating a safety hazard, and also removes the advantage of having light travel through the grating.

There also exist numerous anti-slip compounds which can be applied to surfaces including grating. These compounds come in a variety of colours and transparency levels. However application of an anti-slip coating to grating has been found to be time consuming, ineffective and expensive. Also, where the coating is applied in an outdoor environment, the sheen of the coat may result in a high amount of reflection of light, and create a safety hazard. A further disadvantage of relying on the application of an anti-slip coating is that it requires ongoing and regular maintenance/replenishment.

It is therefore desirable to provide a device that is relatively easy to attach to a fitting such as a grating which can provide an anti-slip benefit. It is also desirable to provide a versatile device which is easily replaced, able to be applied to a wide variety of fittings of different sizes, and which requires minimal maintenance.

SUMMARY OF INVENTION

According to one form of the invention there is provided an attachment device for attachment to a pathway comprising a body having: a top surface for receiving foot traffic thereon; at least one point of flexure; and at least one arm extending from the point of flexure with the arm moveable about the point of flexure, the at least one arm configured to engage the pathway or a structural member of the pathway, wherein when engaged, the at least one arm secures the device to the pathway, wherein engagement of the at least one arm results in the device being compressively secured to the pathway in between two component members of the pathway. The attachment device is able to be easily attached to a portion of a grating-type surface, with minimal movement under regular load. It provides a safer and more robust method of attaching a safety device on grating-type surfaces. Further, unlike the existing prior art, the attachment device is able to be attached to a pathway surface with load bars of varying depths, or in between load bars and cross bars. Further, the attachment device does not need to extend below the depth of any structural members of the pathway for secure attachment. This avoids interference with structural supports that ensure the structural integrity of the pathway. The device can be placed along a surface, in particular a grating-type surface to form a uniform non-slip pattern/surface. Further, by having a point of flexure, the attachment device is able to be secured to pathway surfaces such as grates of both imperial or metric system, as the flexure is able to account for the differences in dimensions.

In one aspect of the invention, each arm extends outwardly from the body. When the at least one arm is engaged with the pathway or a structural member of the pathway, it creates a device attachment bias with the pathway or the structural member of the pathway which secures the device to the pathway, thus minimising movement of the device. In one aspect, the arms may engage with, or create a device attachment bias with, at least two separate members of the pathway to secure the device to the pathway. Alternatively, one arm may engage with a structural member, whilst the opposing side of the device merely rests against another structural member, or is secured to the surface by mechanical means such as a bolt, or through the use of an adhesive.

In another aspect of the invention, the body of the device may comprise a first and an opposing second side, and a recess extending between the first and second sides, wherein the recess is provided for receiving a structural member of the pathway, such as a bearing bar. This allows the device to not only rest between at least two structural members such as cross-bars, but it allows the device to rest across at least three structural members, whereby the central member will be situated in the recess. In addition to making the device more versatile, it provides for a much easier installation and removal process. Further, the recess may be configured to receive a sleeve-adapter to limit any potential movement of the attachment device when attached to the pathway or the structural member of the pathway. This allows the device to be applied to grating components of varying dimensions.

In another aspect of the invention, the body of the device may comprise opposing third and fourth sides, with a central opening extending between the third and fourth sides, wherein a structural member, such as a cross bar, of the pathway is receivable in the opening. This central opening allows the device to be secured to a surface whilst being positioned over a cross-bar, thus making the device versatile in that it can be positioned across edges, and other parts of the surface. Further, the central opening may comprise at least one retaining member for retaining the device to the structural member. The at least one retaining member allows the device to maintain a consistent height, and reduce any potential movement in the central portion when subjected to load.

In one aspect of the invention, the point of flexure is at or proximate the first side. In this aspect, a first arm extends from the first point of flexure. Further, a second point of flexure may be provided at or proximate the second side, having a second arm extending therefrom. A third arm may extend from a third point of flexure provided at or proximate to the first side, and a fourth arm may extend from a fourth point of flexure at or proximate the second side. The device may have one, two, three or four arms, extending from four points of flexure, depending on the requirements of the end user. The device is not restricted to having four arms, and may comprise any number of arms and points of flexure to suit the desired application.

The attachment device is designed with safety in mind. Therefore in an aspect of the invention the device may be equipped with a top surface which may comprise a plurality of protrusions to provide an anti-slip effect. Alternatively, or in addition to the plurality of protrusions, the top surface may be made of a high-friction anti-slip material, or this material may be adhered to the top surface. Further, to facilitate a more streamlined manufacturing process, the entire attachment device may be made-up of a high friction anti-slip material.

To provide adequate engagement of the device with a surface, or structural elements of the surface, the device arms may be configured to engage with specific components. Specifically, with respect to grating, in one aspect of the invention, the arms may be configured to engage with cross bars of a surface grating. Alternatively, where the device arms are required to engage with bearing bars, the arms may be configured to engage with bearing bars of a surface grating. In this aspect, the arms may comprise complimentary grooves which mate with protrusions or other elements of the bearing or cross bars of the surface grating.

The device can be manufactured to different sizes. According to one aspect of the invention, the device may be dimensioned to sit across the width of a single bearing bar of a surface grating, whereby the arms of the device are to engage with cross bars either side of the single bearing bar. In doing so, an attachment bias is created between the device and the pathway, thus securing the device in the desired position. In an alternative aspect, the attachment device may be dimensioned to sit across at least two bearing bars of a surface grating, wherein the arms engage with cross bars either side of the bearing bars. In this aspect, the recess extending between the first and second sides of the device may be used to receive a bearing bar. In an alternative aspect, where the device sits across more than two bearing bars, the device may comprise multiple recesses extending between the first and second sides, so as to receive bearing bars that would otherwise obstruct the device from being able to be attached to the surface.

To enhance the safety characteristics of the device, in one aspect of the invention the device may be phosphorescent or fluorescent. Alternatively the device may comprise a surface coating which is phosphorescent or fluorescent, and/or reflective. The ability to stand out in broad day-light, or glow in the dark allows the device to be used as a guide to safety, or indicate a direction a person following the path should follow. In yet another aspect of the invention, the device may be equipped with LED's, or have reflective strips/indicators attached to its surface. Additionally, words, logos or images may be printed, or adhered to the device.

The device may be made of any number of materials. In one aspect, the device may be made of a plastic, such as acrylonitrile butadiene styrene (ABS), HDPE, or any other plastic considered appropriate for the environment in which the device is to be used.

In an alternative aspect, the device may be made of a metal or an alloy. In yet another aspect, the device may be made up of a combination of plastic, and/or a metal, and/or an alloy. In this respect the body may be made of a plastic, and the arms of a metal or an alloy, or vice versa. Further, the top surface may be made of rubber, or of a plastic with high-friction anti-slip properties. Further, the materials are not limited to those listed, and may also include fibre glass, spring steel, glass or glass compounds, epoxies, carbon fibre, or carbon atom chain based materials. Further, any surface exposed to foot traffic may comprise materials which include sand, or ceramic chips, or metal pieces, or rubber fragments inset, or any other chips, inserts or additives which may increase the friction of between the feet/shoes of those walking on the surface to reduce the risk of slippage.

The versatility of the make-up of the device allows the device to be manufactured and tailored to different environments, being indoors, outdoors, or environments subject to extreme heat or cold.

Where the terms "comprise, "comprises", "comprised" or "comprising" are used in this specification (including the claims) they are to be interpreted as specifying the presence of the stated features, integers, steps or components, but not precluding the presence of one or more other features, integers, steps or components, or group thereto.

BRIEF DESCRIPTION OF DRAWINGS

It will be convenient to hereinafter describe preferred embodiments of the invention with reference to the accompanying figures. The particularity of the figures is to be understood as not limiting the preceding broad description of the invention.

DETAILED DESCRIPTION

FIGS. 1 to 13 show seven versions of the attachment device. In each version shown, the device 2, 402, 502, 602, 702, 802, 902, 1002 has at least one point of flexure 10, 410, 510, 610, 710, 810, 910, 1010 with an arm 12, 412, 512, 612, 712, 812, 912, 1012 extending from the point of flexure 10, 410, 510, 610, 710, 810, 910, 1010, whereby the arm 12, 412, 512, 612, 712, 812, 912, 1012 is moveable about the point of flexure 10, 410, 510, 610, 710, 810, 910, 1010. Each version of the device 2, 402, 502, 602, 702, 802, 902, 1002 is able to be secured to a pathway (for example a grate shown in FIGS. 3, 6 and 11 as 4, 404, 804) through the engagement of the arms 12, 412, 512, 612, 712, 812, 912, 1012 with a component of the pathway.

Figure 3:
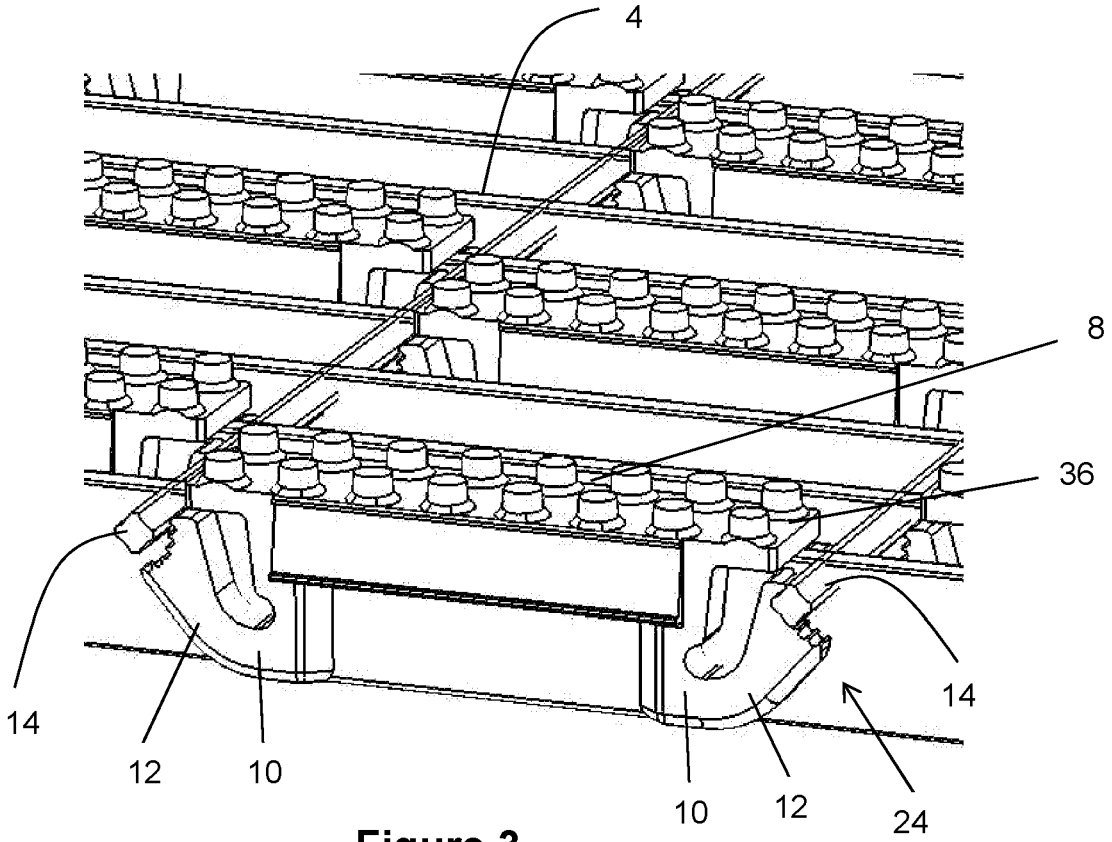
FIG. 3 shows the attachment device of FIG. 1 attached to a grate.
Figure 4:
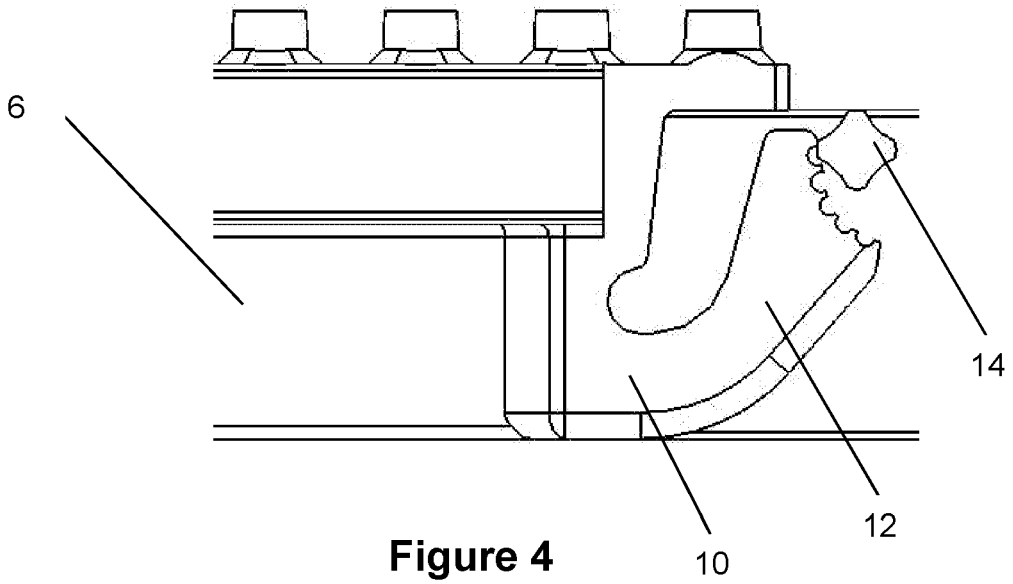
FIG. 4 shows the arm of the attachment device of FIG. 1 in an engaged position with a structural component of a grate.

FIGS. 1 to 4 and 7 show an embodiment of the attachment device 2 for attachment to a pathway 4 comprising a body 6 having: a top surface 8 for receiving foot traffic thereon. The embodiment of FIGS. 1 to 4 and 7 has four points of flexure 10, with each having an arm 12 extending therefrom. Each arm 12 is moveable about the point of flexure 10, and is configured to engage the pathway 4 or a structural member of the pathway 4. As can be seen in FIGS. 3 and 4, when each arm 12 is engaged with the pathway 4 or a structural member of the pathway 14, the attachment device 2 is secured to the pathway 4. Specifically, in FIGS. 3 and 4, each arm 12 is engaged with a cross bar 14 of a grating surface, results in the device 2 being compressively secured to the grating surface in between two component members being cross bars 14.

To provide adequate engagement of the device 2 with a surface, or structural elements of the surface, the device arms 12 may be configured to engage with specific components. For example, with respect to a grating surface 4, and as shown in FIGS. 3, the arms 12 are configured to engage with cross bars 14 of a surface grating 4. As can be seen in FIGS. 1 to 4 and 7, each arm 12 comprises grooves or recesses 16 which correspond in shape to a matching section of the crossbar 14, so as to ensure a reliable engagement between the arm 12, and the crossbar 14. The engagement surface of the arms 12 are not restricted to what is shown in FIGS. 1 to 4 and 7, and may be modified to match the surface of any structural member of a grating surface, or any other surface. Although not shown in the drawings, in an alternative embodiment, the device arms 12 may be configured to engage with bearing bars 24. In this respect, the arms 12 may comprise complimentary grooves which mate with protrusions or other elements of a bearing or cross bar. Alternatively, the arms 12 may comprise a snap-fit or lock-type arrangement, which envelope bearing bars or cross bars, or the arms may merely comprise high-frictional surfaces, which sit in a tolerance or interference fit.

In FIGS. 1 to 4 and 7, each arm 12 extends outwardly from the body 6 and a point of flexure 10, and upwardly from the point of flexure 10. When each arm 12 is engaged with a cross bar 14, an attachment bias is created which secures the device 2 to the pathway 4, thus minimising movement of the device 2. Specifically, when each arm 12 is engaged with a cross bar 14, the arm 12 is subjected to a compressive/inwards force, resulting in movement of the arm 12 inwards towards the body 6 about the point of flexure 10. The point of flexure 10 is designed to allow for movement of the arms 12, whilst also providing sufficient resilience to ensure that the arms 12 will also resist this movement, so as to create a device attachment bias when engaged.

In the embodiment of FIGS. 1 to 4 and 7, the arms 12 engage with, and create an attachment bias with, at least two separate members (being two separate cross-bars 14) of a pathway/grating surface 4 to secure the device 2 to the pathway 4. In an alternative embodiment not shown in the drawings, one arm 12 may engage with a structural member of a pathway, whilst the opposing side of the device 2 merely rests against another structural member, or is secured to the surface by mechanical means such as a cable tie, bolt, or through the use of an adhesive, so as to facilitate a compressive/inwards force to ensure the creation of an attachment bias, and the securing 2 of the device to the pathway 4.

As can be seen in FIGS. 1 to 13, the body 6, 406, 506, 606, 706, 806, 906, 1006 of the device 2, 402, 502, 602, 702, 802, 902, 1002 has a first side 18, 418, 518, 618, 718, 818, 918, 1018 and an opposing second side 20, 420, 520, 620, 720, 820, 920 1020, and a recess 22, 422, 522, 622, 722, 822, 922, 1022 extending between the first side 18, 418, 518, 618, 718, 818, 918, 1018 and second side 20, 420, 520, 620, 720, 820, 920, 1020, wherein the recess 22, 422, 522, 622, 722, 822, 922, 1022 is provided for receiving a structural member of the pathway 4, 404, 804. This allows the device 2, 402, 502, 602, 702, 802, 902, 1002 to not only be situated between at least two structural members 14, 414, 814, but it allows the device to rest on a third structural member, which in FIGS. 3, 6 and 11 is a load/bearing bar 24, 424, 824. In this respect, the load bearing bar 24, 424, 824 is received in the recess 22, 422, 822 when the device 2, 402, 802 is installed. By having the device 2, 402, 502, 602, 702, 802, 902, 1002 configured to receive a bearing bar 24, 424, 824 in its central recess 22, 422, 522, 622, 722, 822, 922, 1022 movement of the device 2, 402, 502, 602, 702, 802, 902, 1002 under load is significantly reduced, thus ensuring the integrity of the engagement of the device 2, 402, 502, 602, 702, 802, 902, 1002 to the pathway 4, 404, 804. Further, having a recess 22, 422, 522, 622, 722, 822, 922, 1022 allows the device to be placed in a variety of positions on a pathway 4, 404, 804, and does not restrict the use or placement of the device 2, 402, 502, 602, 702, 802, 902, 1002.

Figure 8:
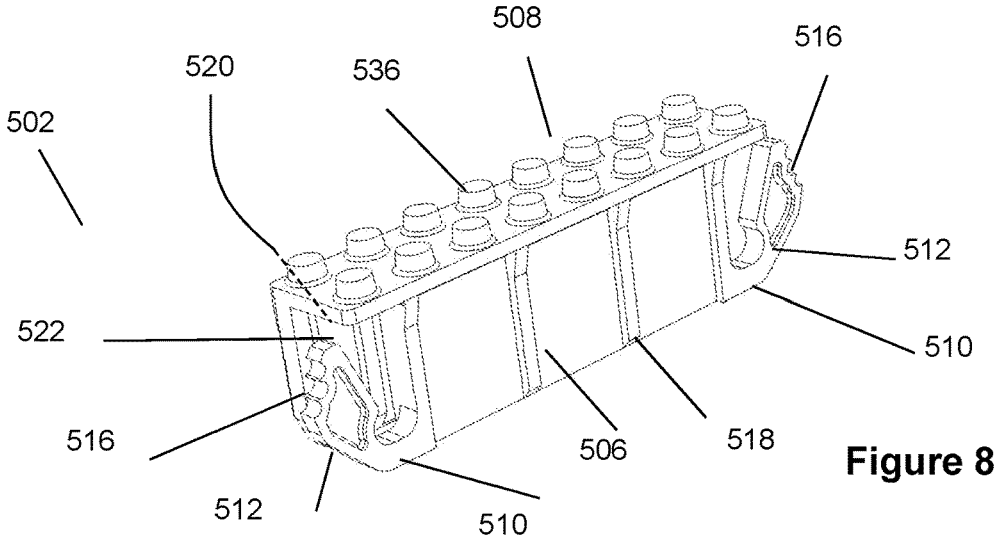
FIG. 8 shows a further embodiment of the attachment device having two arms.
Figure 9:
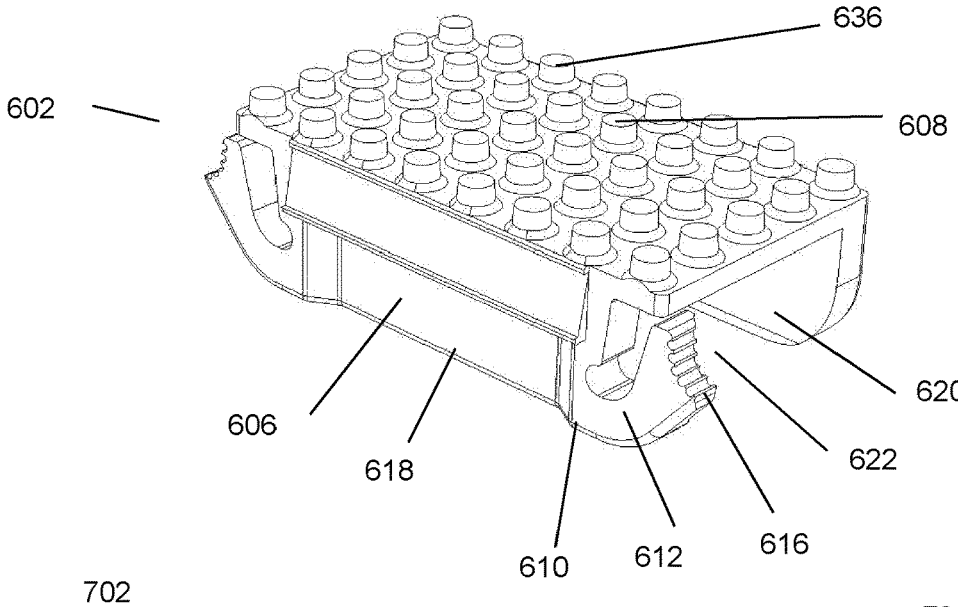
FIG. 9 shows another embodiment of the attachment device capable of extending over multiple grate sections.

Further, as shown in FIGS. 8 and 9, embodiments of the device 502, 602 may only have two arms 512, 612 on the first body side 518, 618 and no arms on the opposing second body side 520, 620. Such an embodiment can be placed in any position along a pathway; however it is more likely to be placed along the edges of a pathway/grating 4, 404, 804 surface shown in FIGS. 3, 6 and 11, and over a bearing bar 24, 424, 824 whereby a cross-bar 14, 414, 814 does not penetrate through the bearing bar 224, 424, 824. In this respect, the second body side 520, 620 serves as an edge cover.

The device 2, 402, 502, 602, 702, 802, 902, 1002 may be manufactured to have one, two, three or four arms 12, 412, 512, 612, 712, 812, 912, 1012 extending from one, two, three or four points of flexure 10, 410, 510, 610, 710, 810, 910, 1010. The number of arms 12, 412, 512, 612, 712, 812, 912, 1012 and points of flexure 10, 410, 510, 610, 710, 810, 910, 1010 can be adjusted in the manufacturing process, depending on the requirements of the end user. In the embodiments shown in FIGS. 1 to 10, and 13 a point of flexure 10, 410, 510, 610, 710, 1010 is at or proximate the first side 18, 418, 518, 618, 718, 1018 and has a first arm 12, 412, 512, 612, 712, 1012 extending from this first point of flexure 10, 410, 510, 610, 710, 1010. Further, a second point of flexure 10, 410, 510, 610, 710, 1010 is provided at or proximate the second side 20, 420, 520, 620, 720, 1020 having a second arm 12, 412, 512, 612, 712, 1012 extending therefrom. In the embodiments of FIGS. 1 to 4, 7, and 10, a third arm 12, 712 extends from a third point of flexure 10, 710 provided at or proximate to the first side 18, 718 and a fourth arm (not visible in the drawings) extends from a fourth point of flexure (not visible in the drawings) at or proximate the second side 20, 720.

Figure 13:
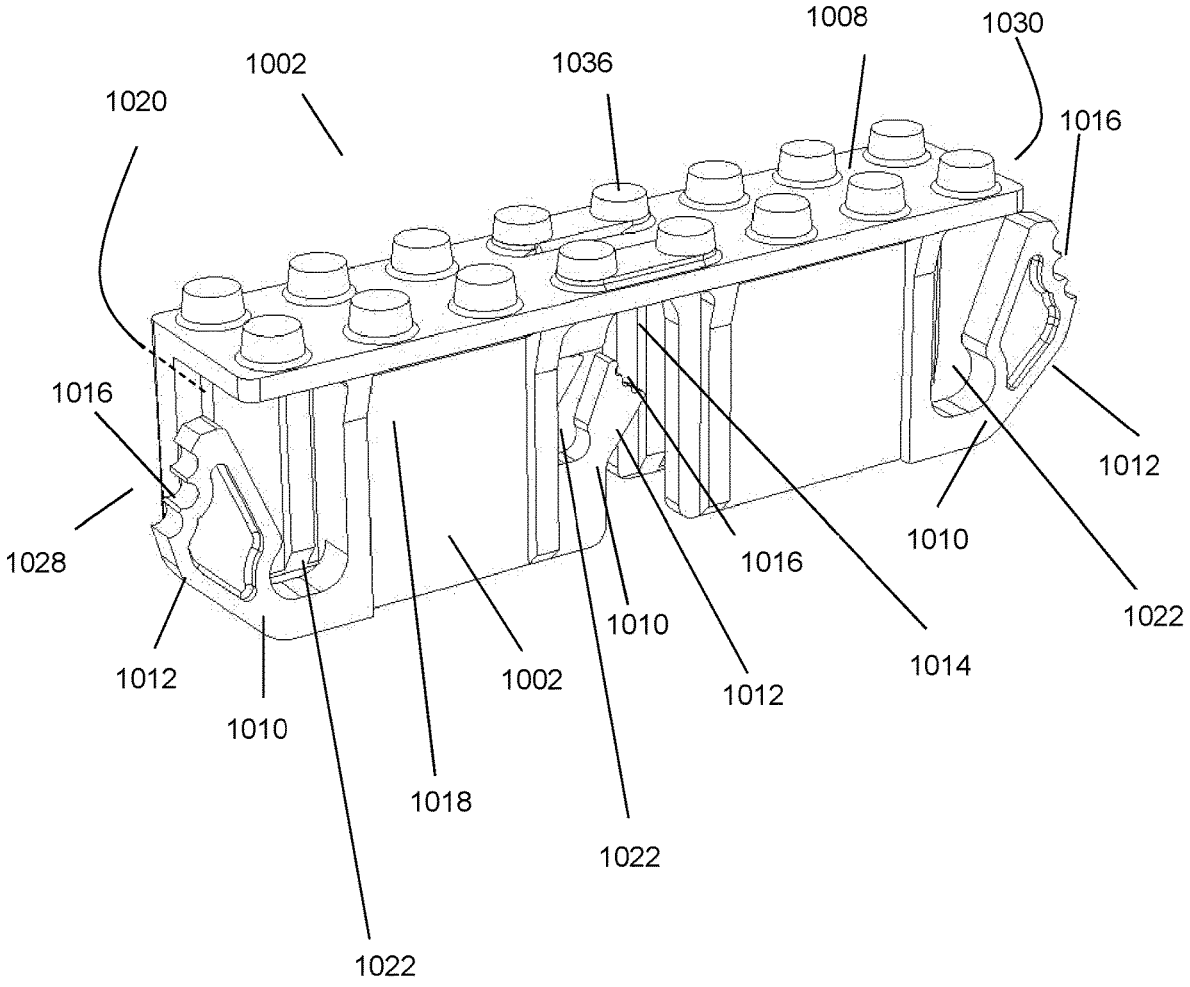
FIG. 13 shows a further alternative embodiment of the attachment device related to the embodiment shown in FIGS. 5 and 6

In the embodiment of FIG. 13, a third point of flexure 1010 is provided on the first side 1018 of the device 1002. The third point of flexure 1010 is situated between the first and second points of flexure 1010. A third arm 1012 extends from the third aperture in an upwardly and outwardly direction, towards a central aperture 1014. A cross-bar 14, 414, 814 such as those depicted in FIGS. 3, 6 and 11 is to be received in the central aperture 1014 and engaged by the third arm 1012. This provides stability throughout the device 1002 of FIG. 13.

Figure 11:
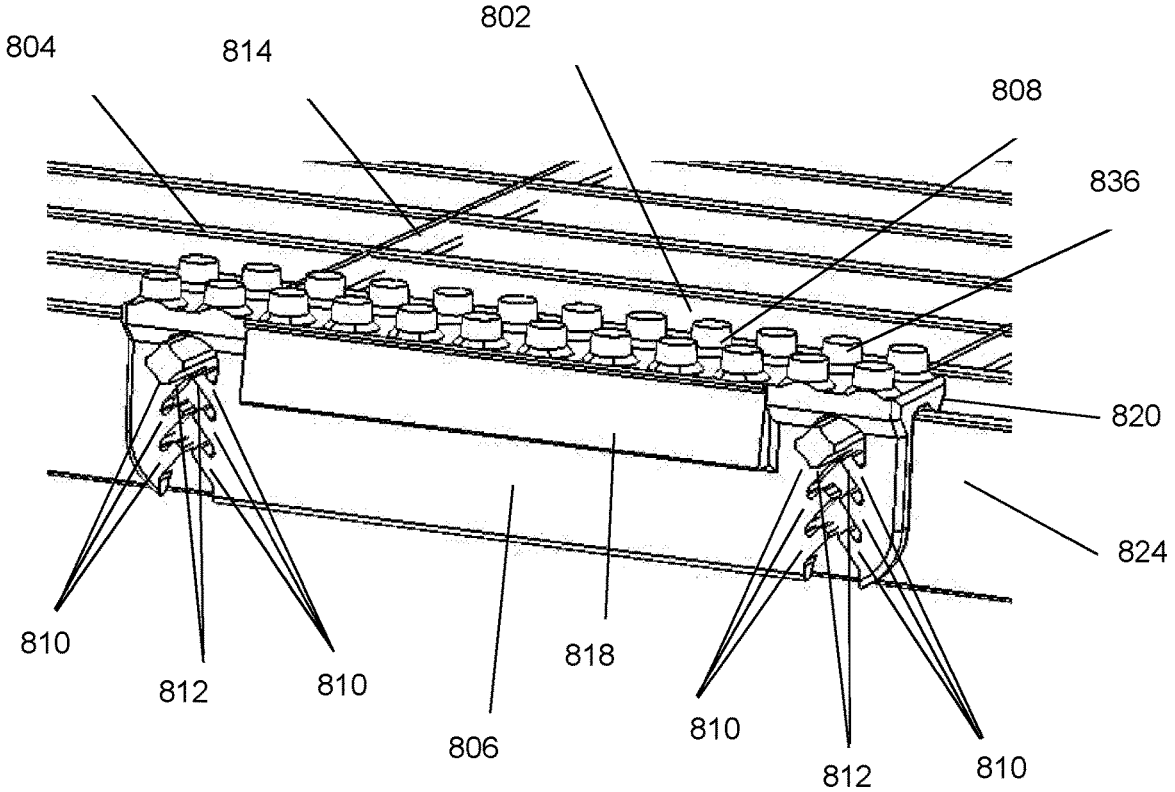
FIG. 11 shows yet another embodiment of the attachment device.
Figure 12:
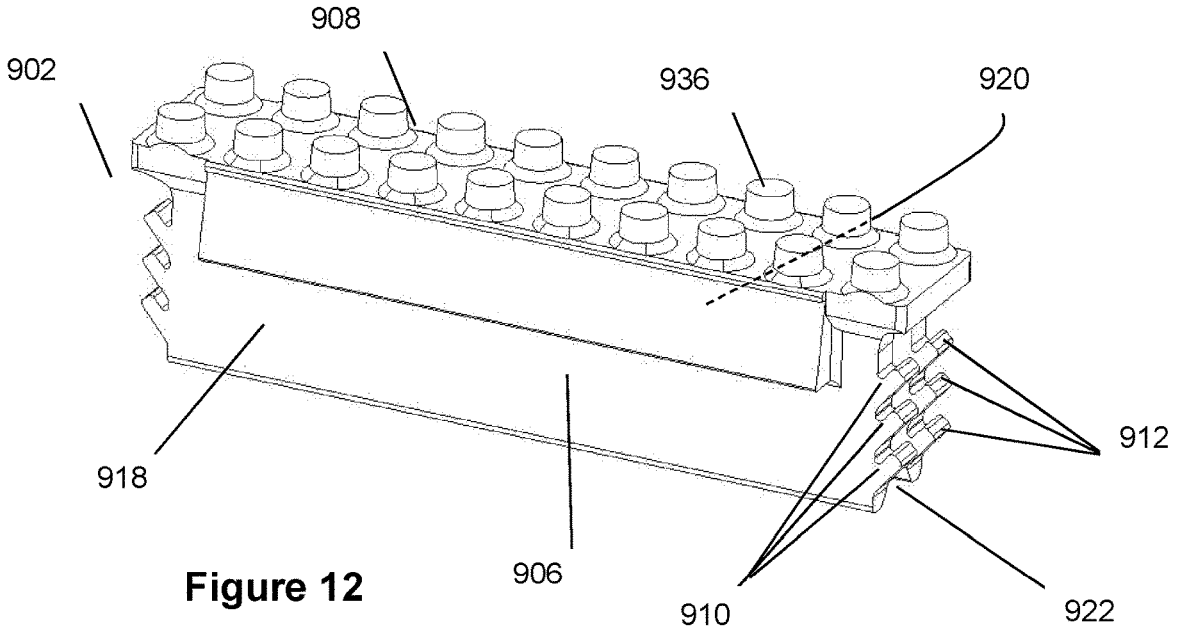
FIG. 12 shows a further alternative embodiment of the attachment device.

Further, as shown in the embodiments of FIGS. 11 and 12, the attachment device 802, 902 can be made to have multiple points of flexure 810, 910 on opposite ends of a first 818, 918 and second side 820, 920. The device of FIG. 11 has two opposing sides 818 and 820. The first side 818 is visible in the drawing of FIG. 11. On the first side 818, there are twelve points of flexure 810 and twelve arms 812 extending therefrom. At each end of the first side 818 there are six points of flexure 810 and six arms 812. Each arm 812 and point of flexure 810 has a corresponding and opposite arm 812 and point of flexure 810. The arms 812 and points of flexure 810 are arranged to engage a cross bar 814, and to secure the cross bar 814 between the corresponding and opposing arms 810, which are located adjacent to each other, on the same first side 818 of the device 802.

Although not entirely visible in FIG. 11, the second side 820 has an identical arrangement of points of flexure 810 and corresponding arms 812 as shown on the first side 818. In an alternative embodiment not shown in the drawings, the second side 820 need not have points of flexure 810 or arms 812, rather in their place there could be a void to merely accommodate the cross bar 814. The device 802 shown in FIG. 11 extends along the length of a bearing bar 824, and over two cross bars 814. Although not shown in the drawings, the device 802 may be made to extend over an indefinite length, and over an indefinite number of load bars 824.

FIG. 12 shows a similar embodiment to that of FIG. 11, with the absence of the set of adjacent and corresponding arms 812. FIG. 12 shows a device 902, having a body 906, with opposing first 918 and second 920 body sides. At each of the four ends of the body sides 918, 920 there are provided three points of flexure 910, and three corresponding arms 912 extending therefrom. In alternative embodiments not shown in the drawings, the number of points of flexure 910 and arms 912 can vary from at least one, to a plurality, for example 24. Further, the first 918 and second 920 opposing sides do not need to be identical, and one opposing side may not have any points of flexure 910 or arms 912, and/or a recess to accommodate a cross bar 14 (as shown in FIG. 11). Rather, one of the opposing sides 918, 920 may be an edge cover.

Figure 1:
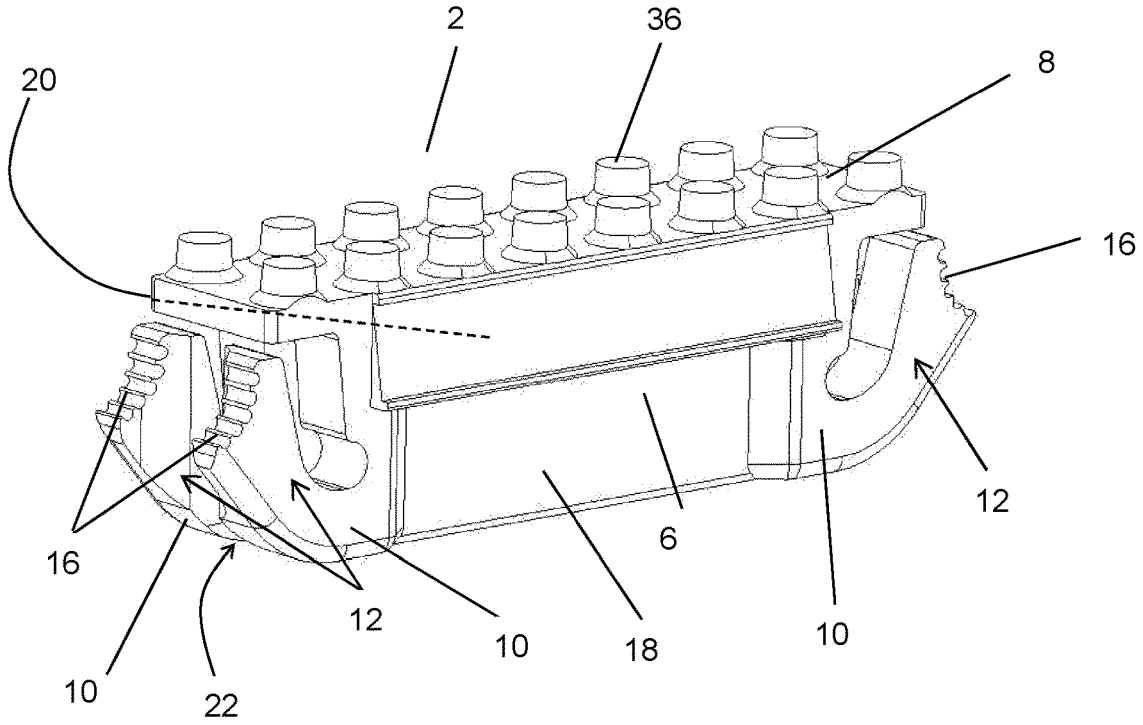
FIG. 1 shows an isometric view of an embodiment of the attachment device.
Figure 2:
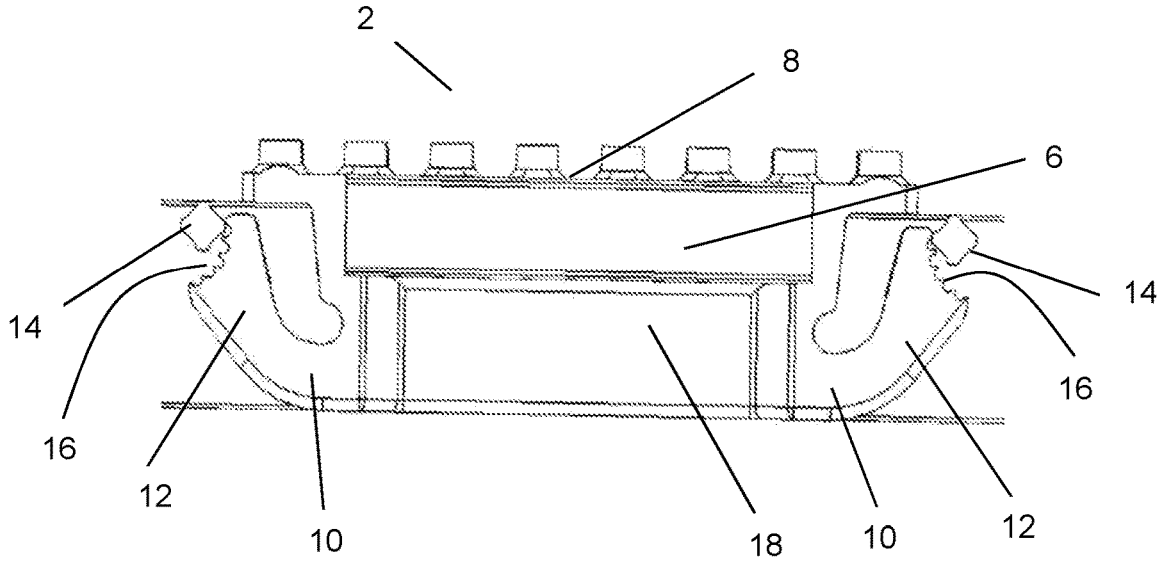
FIG. 2 shows a side view of the attachment device of FIG. 1 attached to a grate.

The arms 812, 912 of FIGS. 11 and 12 are depicted as relatively short members. Although not shown in the drawings, the tips of the arms 812, 912 may be configured to complement the contour of the cross bar 814, so as to provide a better retaining grip of the cross-bar 814. Specifically, the arms 812, 912 may resemble arms 12, as shown in FIG. 1. In this respect, the arms 812, 912 may comprise complimentary grooves (not shown in FIGS. 11 and 12) which mate with protrusions or other elements of a bearing 824 or cross bar 814. Alternatively, the arms 812, 912 may comprise a snap-fit/locking arrangement (not shown in the drawings), which envelope bearing bars 824 or cross bars 814. Alternatively, the arms 812, 914 may merely comprise high-frictional surfaces (not shown in the drawings). In this respect, the device 802, 902 is designed to sit in place through an attachment bias and a tolerance fit arrangement wherein the high-frictional surface of the arms 812, 912 re-enforces the attachment bias/tolerance fit.

Figure 7:
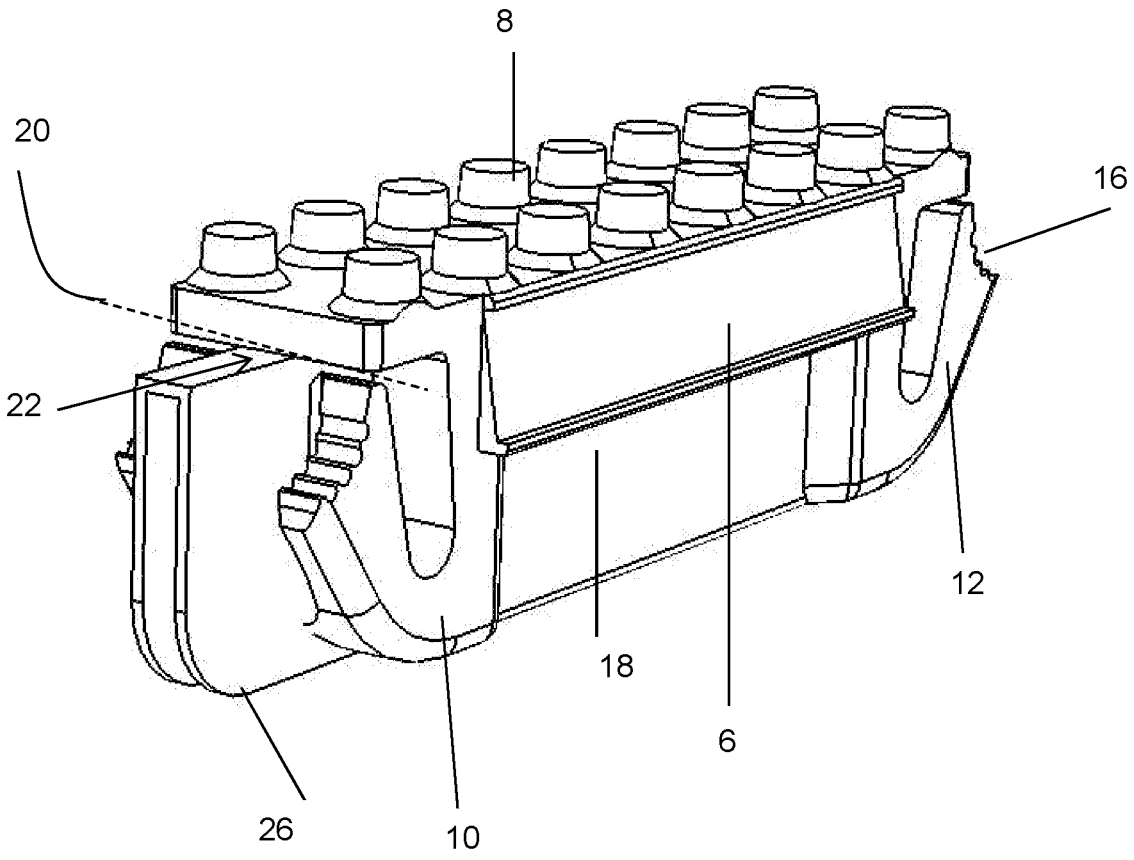
FIG. 7 shows the attachment device of FIG. 1 with a sleeve.
Figure 7:
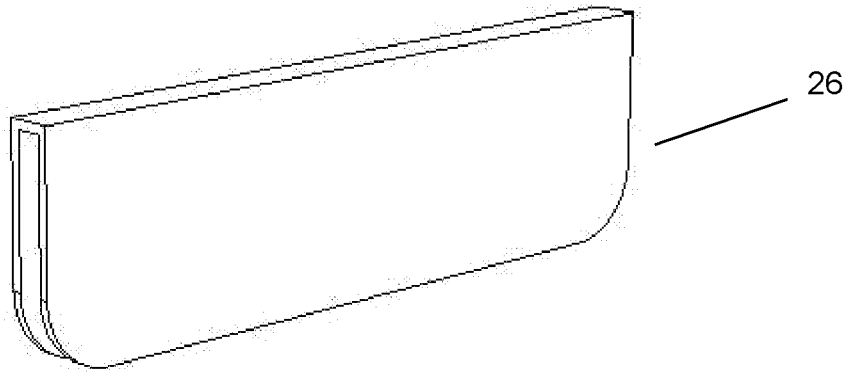

As can be seen in FIG. 7, the recess 22 of the attachment device 2 can receive a sleeve-adapter 26 to limit any potential movement of the attachment device when attached to a pathway 4 or the structural member of the pathway 4. For example, the adapter 26 is used to attach the device 2 to bearing bars 24 of varying widths, whereby the width of the recess 22 may be larger than some or all of the bearing bars on the pathway. Further, the sleeve adapter 26 may be resilient, whereby it can flex so as to tightly attach to bearing bars 24. In an alternative embodiment not shown in the drawings, the sleeve 26 may comprise a snap-fit type arrangement, where by it can snap onto a pathway component. Additionally, the sleeve 26 may be placed in the recess 22 and attached to the device 2 through an interference fit arrangement, or through a snap-fit arrangement, or through the use of a mechanical fastener, or chemical adhesive.

Although not shown in any of the drawings, the sleeve adapter 26 can be made to correspond to the profile of the embodiment of FIGS. 5, 6, 8, 9, 10, 11, and 13 or any profile to which the device 2 is manufactured. In this respect, FIGS. 5, 6, 8, 9, 10, 11, and 13 comprise recesses 422, 522, 622, 722, 822, 922, 1022 which are capable of receiving a sleeve adapter 26, or a structural member of a pathway (such as a bearing bar 24, 424, 824 as shown in FIGS. 3, 6 and 11).

Figure 5:
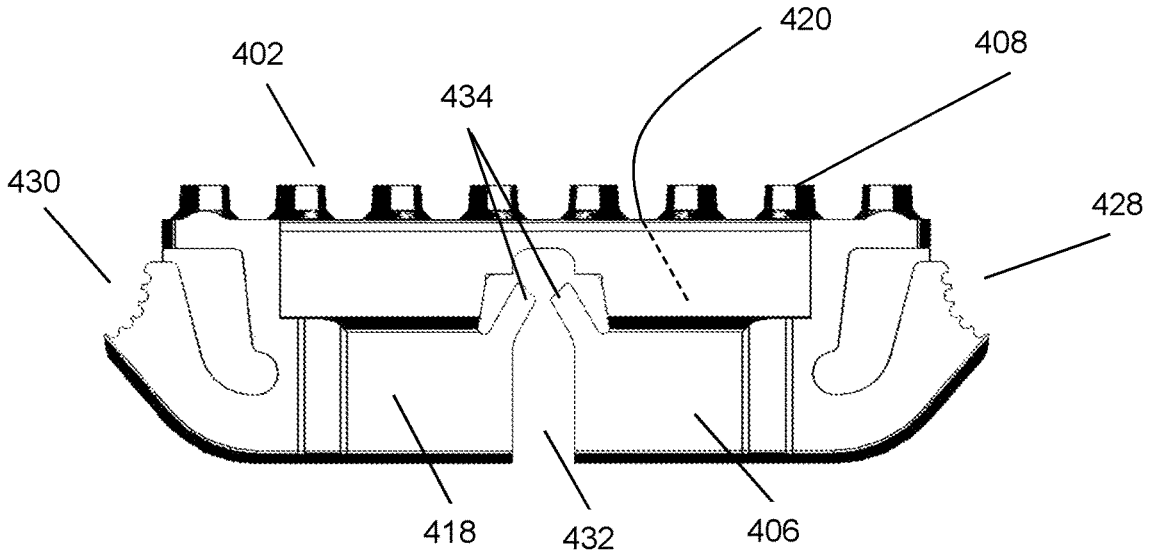
FIG. 5 shows a side view of another embodiment of the attachment device.
Figure 6:
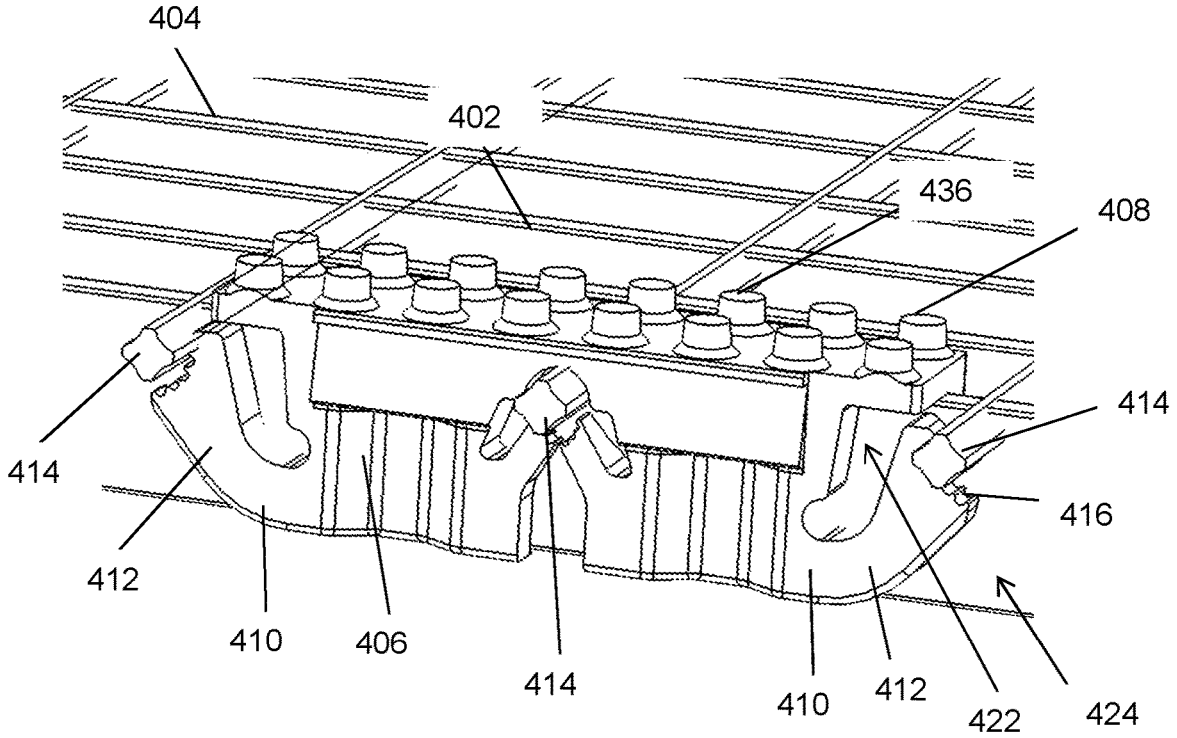
FIG. 6 shows the attachment device of FIG. 5 attached to a grate.

FIGS. 5, 6 and 13 show an embodiment of the attachment device 402, 1002 which is able to sit over both a bearing bar 424 and a cross bar 414. Specifically, the body 406 of the device shown in FIGS. 5 and 6 comprises opposing third 428 and fourth sides 430, with a central opening 432 extending between the third 428 and fourth 430 sides. A structural member, such as a cross bar 414 of the pathway/grating surface 404 is receivable in the opening 432. This central opening 432 allows the device 402 to be secured to a surface 404 whilst being positioned over a cross-bar 414, thus making the device 402 versatile in that it can be positioned across edging, and other parts of the surface, as well as larger lengths of the pathway/grating surface 404.

Further, the central opening 432 shown in FIGS. 5 and 6 has a retaining feature 434, to retain a structural member (in the examples shown the cross bar 424) in the central opening 432. This allows the device 402 to maintain a consistent height without bowing, and reduces any potential play/movement in the central portion when subjected to load. The retaining feature 434 is made up of two adjacently placed members (i.e. placed on the same side wall, being the first body side 418 as shown in the drawings) which resiliently engage the cross bar 414. In an embodiment not shown in the drawings, the device 402 may comprise only a single retaining member. Additionally, the device 402 may comprise two retaining features, on both the first body side 418 and the second body side 420. In essence, the retaining feature is not restricted to the embodiment shown in the drawings.

Similar to the attachment device 402 embodiment shown in FIGS. 5 and 6, the device 1002 of FIG. 13 comprises a central opening in the form of an aperture 1014 that extends between opposing third 1028 and fourth 1030 sides. A structural member, such as a cross bar 414 of the pathway/grating surface 404 is receivable in the opening 1014. An arm 1012 is designed to engage the cross bar 414, and contribute to the attachment bias of the device 1002. As noted above with respect to the device 402 of FIGS. 5 and 6, this central aperture 1014 and the arm 1012 designed to engage a cross bar allows the device 1002 to be secured to a surface 404 whilst being positioned over a cross-bar 14, 414, 814 (shown in FIGS. 3, 6 and 11) thus making the device 1002 versatile in that it can be positioned across edges, and other parts of the surface, as well as larger lengths of the pathway/grating surface 404. The third arm 1012 can act as a retaining feature so as to resiliently engage the cross bar 14, 414, 814. This allows the device 1002 to maintain a consistent height without bowing, and reduces any potential play/movement in the central portion when subjected to load. In an alternative embodiment not shown in FIG. 13, a fourth, fifth and even a sixth arm may exist within the central aperture 1014, each of which will be designed to engage the cross bar 414 running through the central aperture 1014.

Although not shown in the drawings, the devices 502, 602, 702, 802, 902 depicted in FIGS. 8 to 12 may also be manufactured to include any number of central openings 432 and retaining features 434 of the type shown in FIGS. 5, 6 and 13.

The attachment device 2, 402, 502, 602, 702, 802, 902, 1002 is designed with safety in mind, in particular to reduce or eliminate the risk of slippage. As shown in all of the Figures, the device 2, 402, 502, 602, 702, 802, 902, 1002 includes a top surface 8, 408, 508, 608, 708, 808, 908, 1008 having a plurality of protrusions 36, 436, 536, 636, 736, 836, 936, 1036 which provides an anti-slip effect. The protrusions 36, 436, 536, 636, 736, 836, 936, 1036 depicted in the drawings are arranged in linear columns and rows. The protrusions 36, 436, 536, 636, 736, 836, 936, 1036 do not necessarily have to be arranged in the order shown in the drawings, and may be randomly arranged, or arranged in any order so as to provide the desired anti-slip effect. Additionally, and although not shown in the drawings, the top surface 8, 408, 508, 608, 708, 808, 908, 1008 need not necessarily comprise protrusions, rather the surface may comprise any arrangement, pattern, or additional feature which will provide the user with the desired anti-slip (or other) effect.

Further, although not shown in the drawings, the top surface 8, 408, 508, 608, 708, 808, 908, 1008 of the devices 2, 402, 502, 602, 702, 802, 902, 1002 shown in the drawings, and of alternative embodiments, may be made of a high-friction anti-slip material. Alternatively, a high friction anti-slip material may be adhered to the top surface 8, 408, 508, 608, 708, 808, 908, 1008. Further, to facilitate a more streamlined manufacturing process, the entire attachment device 2, 402, 502, 602, 702, 802, 902, 1002 may be made-up of a high friction anti-slip material, or the device 2, 402, 502, 602, 702, 802, 902, 1002 may be partially or entirely coated in the high friction anti-slip material.

Figure 10:
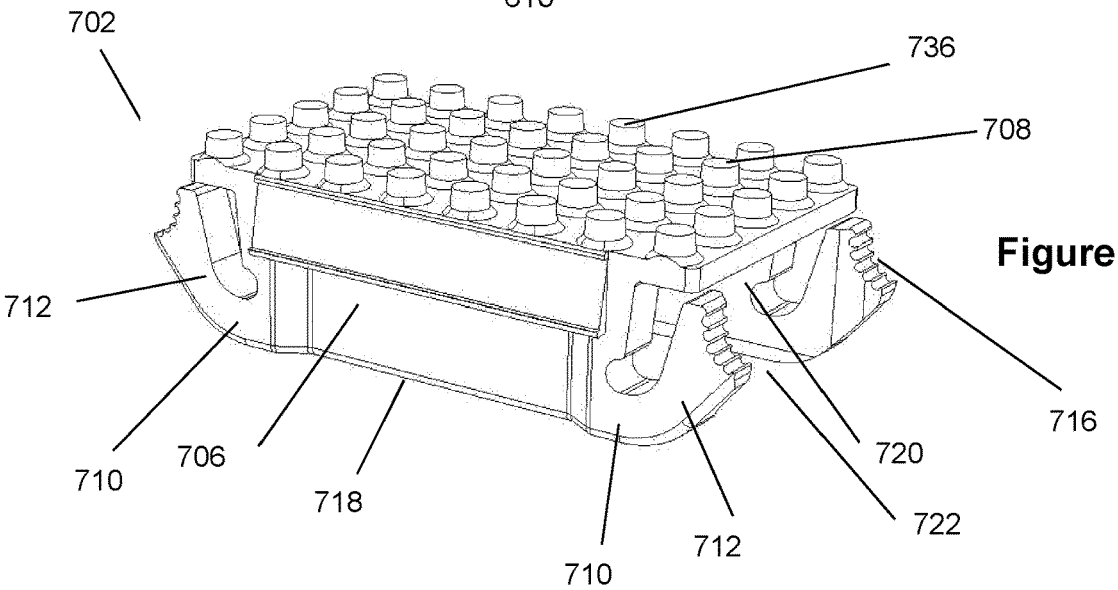
FIG. 10 shows yet another embodiment of the attachment device of FIG. 9, with four arms.

As can be seen in FIGS. 8 to 10, the device 502, 602, 702 is not restricted in dimensions and is manufacturable to different sizes and configurations. FIG. 8 shows an embodiment of the attachment device 502 having two points of flexure 510 and two arms 512 extending therefrom, all of which are located on a first body side 518. The arms 512 of the device 502 in FIG. 8 comprise a plurality of grooves 516 so as to engage with protrusions of a cross bar 14, 414, 814 (as shown in FIGS. 3, 6 and 11), or any other suitable structural member of a pathway surface 4, 404, 804. The second opposing body side 520 has no arms, and acts as a mere cover. In FIGS. 1 to 8, and 11 to 13, the device 2, 402, 502, 802, 902, 1002 is dimensioned to sit across the width of a single bearing bar 24, 424, 824 of a surface grating 4, 404, 804, whereby the arms 12, 412, 512, 812, 912, 1012 of the device are to engage with cross bars 14, 414, 814 either side of a bearing bar 24, 424, 824. In doing so an attachment bias is created between the device 2, 402, 502, 802, 902, 1002 and the pathway 4, 404, 804 thus securing the device 2, 402, 502, 802, 902, 1002 in place along the pathway 4, 404, 804.

FIG. 9 shows a device 602 having a similar configuration to that of the device 502 of FIG. 8, albeit with a relatively larger width. The device 702 of FIG. 10 has a similar configuration to the device 2 of FIG. 1, albeit with a relatively larger width. The devices 602, 702 of FIGS. 9 and 10 are dimensioned to sit across at least two bearing bars 24, 424, 824 (as shown in FIGS. 3, 6 and 11) of a surface grating 4, 404, 824, wherein the arms 612, 712 engage with cross bars 14, 414, 814 either side of the bearing bars 24, 424, 824. In this aspect, the recess 622, 722 extending between the first 618, 718 and second sides 620, 720 of the device may be used to receive and conceal more than one bearing bar 24, 424, 824. In an alternative embodiment not shown in the drawings, the device 2, 402, 502, 602, 702, 802, 902, 1002 may be dimensioned to sit across more than two bearing bars 24, 424, 824 and include a large recess 22, 422, 522, 622, 722, 822, 922, 1022 or multiple recesses (not shown) extending between the first 18, 418, 518, 618, 718, 818, 918, 1018 and second 20, 420, 520, 620, 720, 820, 920, 1020 sides, so as to receive bearing bars 24, 424, 824 that would otherwise obstruct the device 2, 402, 502, 602, 702, 802, 902 from attachment to the surface 4, 404, 824. Where multiple recesses 22, 422, 522, 622, 722, 822, 922, 1022 are used on a single device 2, 402, 502, 602, 702, 802, 902, 1002, they would serve to minimise play/lateral movement about the bearing bars 24, 424, 824.

Further, in an alternative embodiment not shown in the drawings, the device 602, 702 shown in FIGS. 9 and 10 may also include at least one central opening 432, 1014 similar to that shown in FIGS. 5 and 6, or FIG. 3. This alternative embodiment may further comprise central opening retaining members 434 as shown in FIGS. 5 and 6, or at least one arm 1012 as shown in FIG. 13 so as to incorporate any cross-bars 14, 414, 814 which the device extends over.

The attachment device 2, 402, 502, 602, 702, 802, 902, 1002 is designed for use in a broad range of environments, and can be applied to grating type surfaces, or other applicable surfaces to illuminate a particular path, or feature, or to merely provide an aesthetically desirable/decorative look. In this respect the device 2, 402, 502, 602, 702, 802, 902, 1002 may be phosphorescent or fluorescent, and may be manufactured in any colour. Alternatively, the device 2, 402, 502, 602, 702, 802, 902, 1002 may comprise a surface coating which is phosphorescent or fluorescent. Alternatively, and in addition to the phosphorescent or fluorescent properties, the device 2, 402, 502, 602, 702, 802, 902, 1002 may be equipped with LEDs or an alternative light source, or have reflective strips/discs/squares/crystals/indicators attached anywhere on its surface. Where LEDs or an alternative light source is used, the source may be battery powered, or react to a light source, or the device 2 may be configured to connect to a power source which illuminates the LEDs or the light source. In this respect, each device 2, 402, 502, 602, 702, 802, 902, 1002 may be powered individually, or each device 2, 402, 502, 602, 702, 802, 902, 1002 may be connectable to another, and the connected devices 2, 402, 502, 602, 702, 802, 902, 1002 may be powered in an electrical circuit. Alternatively, each device 2, 402, 502, 602, 702, 802, 902, 1002 may comprise solar cells, which are capable of powering the LEDs or alternative light sources. Further, words, logos or images may be printed, or adhered to the device 2, 402, 502, 602, 702, 802, 902, 1002.

In a further embodiment, the device 2, 402, 502, 602, 702, 802, 902, 1002 may have thermochromic properties or photoelectric properties, or include attachments which may be thermochromic or photoelectric, whereby a change in temperature or environmental light will result in a change of colour, or the illumination of a light source. This is particularly useful in the event of a fire or a power outage.

The device 2, 402, 502, 602, 702, 802, 902, 1002 may be made of any number of materials. In one embodiment, the device 2, 402, 502, 602, 702, 802, 902, 1002 may be made of a plastic, such as acrylonitrile butadiene styrene (ABS), HDPE, or any other plastic considered appropriate for the environment in which the device is to be used. Alternatively, the device 2, 402, 502, 602, 702, 802, 902, 1002 may be made of a metal or an alloy; or of a combination of plastic, and/or a metal, and/or an alloy. In one embodiment not shown, the body 6, 406, 506, 606, 706, 806, 906, 1006 of the device 2, 402, 502, 602, 702, 802, 902, 1002 may be made of a plastic, and the arms of a metal or an alloy, or vice versa. Further, the top surface may be made of rubber, or of a plastic with high-frictional anti-slip properties.

The material make-up of the device 2, 402, 502, 602, 702, 802, 902, 1002 is not limited to the materials listed in this specification, and may also include fibre glass, spring steel, glass or glass compounds, epoxies, carbon fibre, or carbon atom chain based materials. Further, any surface exposed to foot traffic may comprise materials including sand insets, or ceramic chips, or metal pieces, or rubber fragments or any components or compositions to enhance the frictional properties of the device so as to reduce the risk of slippage. The versatility of the make-up of the device 2, 402, 502, 602, 702, 802, 902, 1002 allows the device 2, 402, 502, 602, 702, 802, 902, 1002 to be manufactured and tailored to different environments, including indoors, outdoors, or environments subject to extreme heat or extreme cold.

Further, the device 2, 402, 502, 602, 702, 802, 902, 1002 is not restricted for use along a flooring surface, and may be applied to hand rails, walls, ladders, drive ways, accessways, or any other surface. In this respect, the device is not only designed to handle pedestrian traffic, it may also be designed to handle animal traffic (such as livestock), vehicle traffic (cars, trucks, forklifts, loaders), and cargo. Additionally, although not shown in the drawings, all embodiments of the device 2, 402, 502, 602, 702, 802, 902, 1002 may comprise perforations through the top surface 8, 408, 508, 608, 708, 808, 908, 1008 to allow drainage of water through the device 2, 402, 502, 602, 702, 802, 902.

As previously stated, the attachment device 2, 402, 502, 602, 702, 802, 902, 1002 of the present invention provides significant advantages over existing devices, in that it is able to be easily attached to any portion of a grating-type surface, with minimal movement under regular load. In comparison to the prior art devices, the attachment device 2, 402, 502, 602, 702, 802, 902, 1002 operates in a completely different manner. It comprises an attachment bias which runs parallel to load bearing bars 24, 424, 824, and perpendicular to cross-bars 14, 414, 814. The attachment bias of the device 2, 402, 502, 602, 702, 802, 902, 1002 makes it versatile in that it need not be placed over load bearing bars 24, 424, 824 to be attached to a grated floor surface. Further the device 2, 402, 502, 602, 702, 802, 902, 1002 can be configured to receive cross-bars 14, 414, 814. The devices of the prior art document rely on an attachment bias which operates in the opposite manner to that of the device 2, 402, 502, 602, 702, 802, 902, 1002 of the present application, constricting them to being placed over load bearing bars 24, 424, 824, and between cross-bars 14, 414, 814.

Further, the device 2, 402, 502, 602, 702, 802, 902, 1002 provides a safer and more robust method of attaching a safety device 2, 402, 502, 602, 702, 802, 902, 1002 on grating-type surfaces 4, 404, 804. Further, unlike the existing prior art, the attachment device 2, 402, 502, 602, 702, 802, 902, 1002 is able to be attached to a pathway surface 4, 404, 804 with load bars of varying depths. Further, the attachment device 2, 402, 502, 602, 702, 802, 902, 1002 does not need to extend below the depth of any structural members of the pathway for secure attachment. This avoids interference with structural supports that may ensure the structural integrity of the pathway 4, 404, 804. The device 2, 402, 502, 602, 702, 802, 902, 1002 can be placed anywhere along a surface, in particular a grating-type surface to form a uniform non-slip pattern/surface. Further, by having a point of flexure, the attachment device 2, 402, 502, 602, 702, 802, 902, 1002 is able to be secured to pathway surfaces 4,

404, 804 such as grates of both imperial and/or metric systems, as the flexure is able to account for the differences in dimensions.

It is to be understood that various alterations, modifications and/or additions may be introduced into the construction and arrangement of the parts previously described without departing from the spirit or ambit of this invention.

LIST OF REFERENCE NUMERALS

2—Attachment device of FIGS. 1 to 4, and 7
4—Pathway/surface grating of FIG. 3
6—Body of FIGS. 1 to 4, and 7
8—Top surface of FIGS. 1 to 4, and 7
10—Points of flexure of FIGS. 1 to 4, and 7
12—Device Arms of FIGS. 1 to 4, and 7
14—Cross bar of FIG. 3
16—Grooves or recesses of FIGS. 1 to 4, and 7
18—First body side of FIGS. 1 to 4, and 7
20—Second body side of FIGS. 1 to 4, and 7
22—Recess of embodiment of FIGS. 1 to 4, and 7
24—Bearing bar of FIG. 3
26—Sleeve Adapter of FIG. 7
36—Plurality of protrusions of FIGS. 1 to 4, and 7
402—Attachment device of FIGS. 5 and 6
404—Pathway/surface grating of FIGS. 5 and 6
406—Body of FIGS. 5 and 6
408—Top surface of FIGS. 5 and 6
410—Points of flexure of FIGS. 5 and 6
412—Device Arms of FIGS. 5 and 6
414—Cross bar of FIG. 6
416—Grooves or recesses of FIGS. 5 and 6
418—First body side of FIGS. 5 and 6
420—Second body side FIGS. 5 and 6
422—Recess of FIGS. 5 and 6
424—Bearing bar of FIGS. 5 and 6
428—Third side of FIGS. 5 and 6
430—Fourth side of FIGS. 5 and 6
432—Central opening of FIGS. 5 and 6
434—Central opening retaining members of FIGS. 5 and 6
436—Plurality of protrusions of FIGS. 5 and 6
502—Attachment device of FIG. 8
506—Body of FIG. 8
508—Top surface of FIG. 8
510—Points of flexure of FIG. 8
512—Device Arms of FIG. 8
516—Grooves or recesses of FIG. 8
518—First body side of FIG. 8
520—Second body side FIG. 8
522—Recess of FIG. 8
536—Plurality of protrusions of FIG. 8
602—Attachment device of FIG. 9
606—Body of FIG. 9
608—Top surface of FIG. 9
610—Points of flexure of FIG. 9
612—Device Arms of FIG. 9
616—Grooves or recesses of FIG. 9
618—First body side of FIG. 9
620—Second body side FIG. 9
622—Recess of FIG. 9
636—Plurality of protrusions of FIG. 9
702—Attachment device of FIG. 10
706—Body of FIG. 10
708—Top surface of FIG. 10
710—Points of flexure of FIG. 10
712—Device Arms of FIG. 10
716—Grooves or recesses of FIG. 10
718—First body side of FIG. 10
720—Second body side FIG. 10
722—Recess of FIG. 10
736—Plurality of protrusions of FIG. 10
802—Attachment device of FIG. 11
804—Pathway/surface grating of FIG. 11
806—Body of FIG. 11
808—Top surface of FIG. 11
810—Points of flexure of FIG. 11
812—Device Arms of FIG. 11
814—Cross bar of FIG. 11
818—First body side of FIG. 11
820—Second body side FIG. 11
822—Recess of FIG. 11
824—Bearing bar of FIG. 11
836—Plurality of protrusions of FIG. 11
902—Attachment device of FIG. 11
906—Body of FIG. 11
908—Top surface of FIG. 11
910—Points of flexure of FIG. 11
912—Device Arms of FIG. 11
918—First body side of FIG. 11
920—Second body side FIG. 11
922—Recess of FIG. 11
936—Plurality of protrusions of FIG. 11
1002—Attachment device of FIG. 13
1006—Body of FIG. 13
1008—Top surface of FIG. 13
1010—Points of flexure of FIG. 13
1012—Device Arms of FIG. 13
1014—Central Opening/Cross bar receiving portion of FIG. 13
1016—Grooves or recesses of FIG. 13
1018—First body side of FIG. 13
1020—Second body side FIG. 13
1022—Recess of FIGS. 5 and 6
1028—Third side of FIG. 13
1030—Fourth side of FIG. 13
1036—Plurality of protrusions of FIG. 13

The invention claimed is:

1. An attachment device for attachment to a pathway comprising a body having:
a top surface for receiving foot traffic thereon;
at least one point of flexure; and
at least one arm extending from the point of flexure with the arm moveable about the point of flexure, the at least one arm configured to engage the pathway or a structural member of the pathway, wherein when engaged, the at least one arm secures the device to the pathway, wherein engagement of the at least one arm results in the device being compressively secured to the pathway in between two component members of the pathway,
the device is dimensioned to sit across the width of a single bearing bar of a surface grating, and
wherein the arms engage with cross bars at either side of the single bearing bar.

2. The device according to claim 1 wherein each arm extends outwardly from the body.

3. The device according to claim 1, wherein when the at least one arm is engaged with the pathway or a structural member of the pathway, it creates a device attachment bias with the pathway or the structural member of the pathway which secures the device to the pathway.

4. The device according to claim 1, wherein the arms engage with, or create a device attachment bias with, at least two separate members of the pathway to secure the device to the pathway.

5. The device according to claim 1, wherein the top surface comprises a plurality of protrusions to provide an anti-slip effect.

6. The device according to claim 1, wherein the top surface is of a high friction anti-slip material.

7. The device according to claim 1, wherein the high friction anti-slip material is adhered to the top surface.

8. The device according to claim 1, wherein the entire attachment device is manufactured from a high friction anti-slip material.

9. The device according to claim 1, wherein the device arms are configured to engage with cross bars of a surface grating.

10. The device according to claim 1, wherein the arms are configured to engage with bearing bars of a surface grating.

11. The device according to claim 1, wherein the device or a device coating is provided on the surface of the device is phosphorescent or fluorescent.

12. The device according to claim 1, wherein the device is made of a plastic.

13. The device according to claim 1, wherein the device is made of a metal or an alloy metal.

14. The device according to claim 1, wherein the device is made up of a combination of plastic, and/or a metal, and/or a metal alloy.

15. The device according to claim 1, wherein the device comprises perforations for drainage of liquids.

16. The device according to claim 1, wherein the body comprises a first and an opposing second side, and a recess extending between the first and second sides, the recess provided for receiving the structural member of the pathway.

17. The device according to claim 16, wherein the recess is configured to receive a sleeve-adapter to limit any potential movement of the attachment device when attached to the pathway or the structural member of the pathway.

18. The device according to claim 16, wherein the body comprises opposing third and fourth sides, with a central opening extending between the third and fourth sides, wherein a structural member of the pathway is receivable in the opening.

19. The device according to claim 18, wherein the central opening comprises at least one retaining member for retaining the device to the structural member.

20. The device according to claim 16, wherein the point of flexure is at or proximate the first side, and wherein a first arm extends from the first point of flexure.

21. The device according to claim 16, wherein a second point of flexure is provided at or proximate the second side, and wherein a second arm extends from the second point of flexure.

22. The device according to claim 21, wherein a third arm extends from a third point of flexure provided at or proximate to the first side.

23. The device according to claim 22, wherein a fourth arm extends from a fourth point of flexure at or proximate the second side.

24. An attachment device for attachment to a pathway comprising a body having:

a top surface for receiving foot traffic thereon;

at least one point of flexure; and at least one arm extending from the point of flexure with the arm moveable about the point of flexure, the at least one arm configured to engage the pathway or a structural member of the pathway, wherein when engaged, the at least one arm secures the device to the pathway, wherein engagement of the at least one arm results in the device being compressively secured to the pathway in between two component members of the pathway, the device is dimensioned to sit across at least two bearing bars of a surface grating, wherein the arms engage with cross bars at either side of the bearing bars.

* * * * *